US009487850B2

(12) United States Patent
Wetzel et al.

(10) Patent No.: US 9,487,850 B2
(45) Date of Patent: Nov. 8, 2016

(54) ULTRA HIGH STRENGTH COPPER-NICKEL-TIN ALLOYS

(71) Applicant: Materion Corporation, Mayfield Heights, OH (US)

(72) Inventors: John F. Wetzel, Hamburg, PA (US); Ted Skoraszewski, New Ringold, PA (US)

(73) Assignee: Materion Corporation, Mayfield Heights, OH (US)

( * ) Notice: Subject to any disclaimer, the term of this patent is extended or adjusted under 35 U.S.C. 154(b) by 176 days.

(21) Appl. No.: 14/204,681

(22) Filed: Mar. 11, 2014

(65) Prior Publication Data

US 2014/0261925 A1 Sep. 18, 2014

Related U.S. Application Data

(60) Provisional application No. 61/781,942, filed on Mar. 14, 2013.

(51) Int. Cl.
*C22F 1/08* (2006.01)
*C22C 9/06* (2006.01)

(52) U.S. Cl.
CPC .. *C22F 1/08* (2013.01); *C22C 9/06* (2013.01)

(58) Field of Classification Search
CPC ..... C22C 9/06; C22F 1/08
See application file for complete search history.

(56) References Cited

U.S. PATENT DOCUMENTS 3,198,499 A 8/1965 Stanley
5,089,057 A 2/1992 Plewes

OTHER PUBLICATIONS

Materion Brush Inc., et al., "BrushForm® 158 Cold Rolled Tempers," Materion Datasheet [online], Retrieved from the Internet <URL: http://materion.com/~/media/Files/PDFs/Alloy/DataSheets/Copper%20Nickel%20Tin%20Strip/Brushforms-DataSheets-Brushform158ColledRolled.pdf>; p. 1, Retrieved on May 19, 2014.
International Search Report for PCT/US14/23522, dated Jun. 5, 2014.

*Primary Examiner* — Veronica F Faison
(74) *Attorney, Agent, or Firm* — Richard M. Klein; Fay Sharpe LLP

(57) ABSTRACT

The present disclosure relates to ultra high strength wrought copper—nickel—tin alloys and processes for improving the yield strength of the copper—nickel—tin alloy such that the resulting 0.2% offset yield strength is at least 175 ksi. The alloy includes about 14.5 wt % to about 15.5% nickel, about 7.5 wt % to about 8.5% tin, and the remaining balance is copper. The steps include cold working the copper—nickel—tin alloy wherein the alloy undergoes between 50%-75% plastic deformation. The alloy is heat treated at elevated temperatures between about 740° F. and about 850° F. for a time period of about 3 minutes to 14 minutes.

10 Claims, 2 Drawing Sheets

ULTRA HIGH STRENGTH COPPER-NICKEL-TIN ALLOYS

RELATED APPLICATION

This application claims priority to U.S. Provisional Patent Application Ser. No. 61/781,942, filed on Mar. 14, 2013, the contents of which are fully incorporated by reference herein.

BACKGROUND

The present disclosure relates to ultra high strength wrought copper—nickel—tin alloys and processes for enhancing the yield strength characteristics of the copper—nickel—tin alloy. In particular, the copper—nickel—tin alloys undergo a processing method that results in substantially higher strength levels from known alloys and processes, and will be described with particular reference thereto.

Copper—beryllium alloys are used in voice coil motor (VCM) technology. VCM technology refers to various mechanical and electrical designs that are used to provide high-resolution, auto-focus, optical zooming camera capability in mobile devices. This technology requires alloys that can fit within confined spaces that also have reduced size, weight and power consumption features to increase portability and functionality of the mobile device. Copper—beryllium alloys are utilized in these applications due to their high strength, resilience and fatigue strength.

Some copper—nickel—tin alloys have been identified as having desirable properties similar to those of copper—beryllium alloys, and can be manufactured at a reduced cost. For example, a copper—nickel—tin alloy offered as Brushform® 158 (BF 158) by Materion Corporation, is sold in various forms and is a high-performance, heat treated alloy that allows a designer to form the alloy into electronic connectors, switches, sensors, springs and the like. These alloys are generally sold as a wrought alloy product in which a designer manipulates the alloy into a final shape through working rather than by casting. However, these copper—nickel—tin alloys have formability limitations compared to copper—beryllium alloys.

Therefore, it would be desirable to develop new ultra high strength copper—nickel—tin alloys and processes for that would improve the yield strength characteristics of such alloys.

BRIEF DESCRIPTION

The present disclosure relates to an ultra high strength copper—nickel—tin alloy and a method to improve the 0.2% offset yield strength (hereinafter abbreviated "yield strength") of the copper—nickel—tin alloy such that the resulting yield strength is at least 175 ksi. Generally, the alloy is first mechanically cold worked to undergo a plastic deformation % CW (i.e. percentage cold working) of about 50% to about 75%. The alloy then undergoes a thermal stress relief step by heating to an elevated temperature between about 740° F. and about 850° F. for a period of between about 3 minutes and about 14 minutes to produce the desired formability characteristics.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
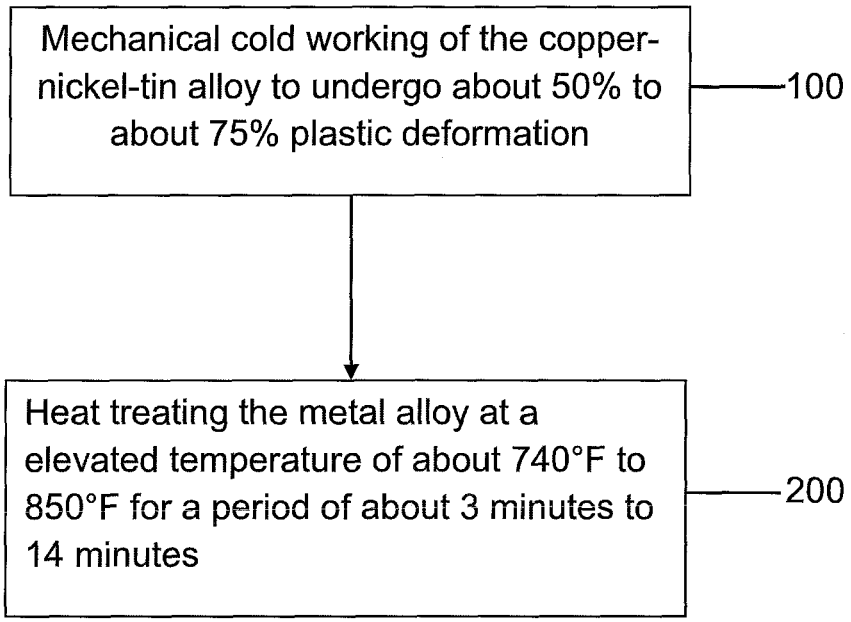
FIG. 1 is a flow chart illustrating an exemplary method of the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

A value modified by a term or terms, such as "about" and "substantially," may not be limited to the precise value specified. The approximating language may correspond to the precision of an instrument for measuring the value. The modifier "about" should also be considered as disclosing the range defined by the absolute values of the two endpoints. For example, the expression "from about 2 to about 4" also discloses the range "from 2 to 4."

Percentages of elements should be assumed to be percent by weight of the stated alloy, unless expressly stated otherwise.

As used herein, the term "spinodal alloy" refers to an alloy whose chemical composition is such that it is capable of undergoing spinodal decomposition. The term "spinodal alloy" refers to alloy chemistry, not physical state. Therefore, a "spinodal alloy" may or may not have undergone spinodal decomposition and may or not be in the process of undergoing spinodal decomposition.

Spinodal aging/decomposition is a mechanism by which multiple components can separate into distinct regions or microstructures with different chemical compositions and physical properties. In particular, crystals with bulk composition in the central region of a phase diagram undergo exsolution. Spinodal decomposition at the surfaces of the alloys of the present disclosure results in surface hardening.

Spinodal alloy structures are made of homogeneous two phase mixtures that are produced when the original phases are separated under certain temperatures and compositions referred to as a miscibility gap that is reached at an elevated temperature. The alloy phases spontaneously decompose into other phases in which a crystal structure remains the same but the atoms within the structure are modified but remain similar in size. Spinodal hardening increases the yield strength of the base metal and includes a high degree of uniformity of composition and microstructure.

The copper—nickel—tin alloy utilized herein generally includes from about 9.0 wt % to about 15.5 wt % nickel, and from about 6.0 wt % to about 9.0 wt % tin, with the remaining balance being copper. This alloy can be hardened and more easily formed into high yield strength products that can be used in various industrial and commercial applications. This high performance alloy is designed to provide properties similar to copper-beryllium alloys.

More particularly, the copper—nickel—tin alloys of the present disclosure include from about 9 wt % to about 15 wt % nickel and from about 6 wt % to about 9 wt % tin, with the remaining balance being copper. In more specific embodiments, the copper—nickel—tin alloys include from about 14.5 wt % to about 15.5% nickel, and from about 7.5 wt % to about 8.5 wt % tin, with the remaining balance being copper. These alloys can have a combination of various properties that separate the alloys into different ranges. The present disclosure is directed towards alloys that are designated TM12. More specifically, "TM12" refers to copper—nickel—tin alloys that generally have a 0.2% offset yield strength of at least 175 ksi, an ultimate tensile strength of at least 180 ksi, and a minimum % elongation at break of 1%. To be considered a TM12 alloy, the yield strength of the alloy must be a minimum of 175 ksi.

FIG. 1 is a flowchart that outlines the steps of the metal working processes of the present disclosure for obtaining a TM12 alloy. The metal working process begins by first cold working the alloy 100. The alloy then undergoes a heat treatment 200.

Cold working is the process of mechanically altering the shape or size of the metal by plastic deformation. This can be done by rolling, drawing, pressing, spinning, extruding or heading of the metal or alloy. When a metal is plastically deformed, dislocations of atoms occur within the material. Particularly, the dislocations occur across or within the grains of the metal. The dislocations over-lap each other and the dislocation density within the material increases. The increase in over-lapping dislocations makes the movement of further dislocations more difficult. This increases the hardness and tensile strength of the resulting alloy while generally reducing the ductility and impact characteristics of the alloy. Cold working also improves the surface finish of the alloy. Mechanical cold working is generally performed at a temperature below the recrystallization point of the alloy, and is usually done at room temperature. The percentage of cold working (% CW), or the degree of deformation, can be determined by measuring the change in the cross-sectional area of the alloy before and after cold working, according to the following formula:

$$\% CW = 100*[A_0 - A_f]/A_0$$

where $A_0$ is the initial or original cross-sectional area before cold working, and $A_f$ is the final cross-sectional area after cold working. It is noted that the change in cross-sectional area is usually due solely to changes in the thickness of the alloy, so the % CW can also be calculated using the initial and final thickness as well.

The initial cold working step 100 is performed on the alloy such that the resultant alloy has a plastic deformation in a range of 50%-75% cold working. More particularly, the cold working % achieved by the first step can be about 65%.

The alloy then undergoes a heat treatment step 200. Heat treating metal or alloys is a controlled process of heating and cooling metals to alter their physical and mechanical properties without changing the product shape. Heat treatment is associated with increasing the strength of the material but it can also be used to alter certain manufacturability objectives such as to improve machining, improve formability, or to restore ductility after a cold working operation. The heat treating step 200 is performed on the alloy after the cold working step 100. The alloy is placed in a traditional furnace or other similar assembly and then exposed to an elevated temperature in the range of about 740° F. to about 850° F. for a time period of from about 3 minutes to about 14 minutes. It is noted that these temperatures refer to the temperature of the atmosphere to which the alloy is exposed, or to which the furnace is set; the alloy itself does not necessarily reach these temperatures. This heat treatment can be performed, for example, by placing the alloy in strip form on a conveyor furnace apparatus and running the alloy strip at a rate of about 5 ft/min through the conveyor furnace. In more specific embodiments, the temperature is from about 740° F. to about 800° F.

This process can achieve a yield strength level for the ultra high strength copper—nickel—tin alloy that is at least 175 ksi. This process has consistently been identified to produce alloy having a yield strength in the range of about 175 ksi to 190 ksi. More particularly, this process can process alloy with a resulting yield strength (0.2% offset) of about 178 ksi to 185 ksi.

A balance is reached between cold working and heat treating. There is an ideal balance between an amount of strength that is gained from cold working wherein too much cold working can adversely affect the formability characteristics of this alloy. Similarly, if too much strength gain is derived from heat treatment, formability characteristics can be adversely affected. The resulting characteristics of the TM12 alloy include a yield strength that is at least 175 ksi. This strength characteristic exceeds the strength features of other known similar copper—nickel—tin alloys.

The following examples are provided to illustrate the alloys, articles, and processes of the present disclosure. The examples are merely illustrative and are not intended to limit the disclosure to the materials, conditions, or process parameters set forth therein.

EXAMPLES

Copper—nickel—tin alloys containing 15 wt % nickel, 8 wt % tin, and balance copper were formed into strips. The strips were then cold worked using a rolling assembly. The strips were cold worked and measured at % CW of 65%. Next, the strips underwent a heat treatment step using a conveyor furnace apparatus. The conveyor furnace was set at temperatures of 740° F., 760° F., 780° F., 800° F., 825° F., or 850° F. The strips were run through the conveyor furnace at a line speed of 5, 10, 15, or 20 ft/min. Two strips were used for each combination of temperature and speed.

Various properties were then measured. Those properties included the ultimate tensile strength (T) in ksi; the 0.2% offset yield strength (Y) in ksi; the % elongation at break (E); and the Young's modulus (M) in millions of pounds per square inch (10^6 psi). Table 1 and Table 2 provide the measured results. The average values for T and Y are also provided.

TABLE 1

| Temp | FPM | T | Y | Avg T | Avg Y | E | M |
|---|---|---|---|---|---|---|---|
| 740 | 5 | 187.1 | 180.6 | | | 1.77 | 16.88 |
| 740 | 5 | 183.3 | 180.0 | 185.2 | 180.3 | 1.43 | 16.89 |
| 740 | 10 | 179.2 | 173.5 | | | 1.73 | 16.93 |
| 740 | 10 | 180.7 | 175.4 | 180.0 | 174.5 | 1.64 | 16.89 |
| 740 | 15 | 175.0 | 171.2 | | | 1.54 | 16.95 |
| 740 | 15 | 173.8 | 168.9 | 174.4 | 170.0 | 1.60 | 17.00 |
| 740 | 20 | 168.2 | 161.6 | | | 1.61 | 16.64 |
| 740 | 20 | 171.0 | 165.9 | 169.6 | 163.7 | 2.05 | 16.98 |
| 760 | 5 | 190.4 | 182.0 | | | 1.83 | 16.72 |
| 760 | 5 | 187.8 | 181.6 | 189.1 | 181.8 | 1.62 | 16.78 |
| 760 | 10 | 183.4 | 176.8 | | | 1.60 | 16.90 |
| 760 | 10 | 183.1 | 174.4 | 183.3 | 175.6 | 2.00 | 16.80 |
| 760 | 15 | 178.3 | 170.2 | | | 1.97 | 16.89 |
| 760 | 15 | 181.1 | 173.5 | 179.7 | 171.8 | 1.90 | 16.76 |
| 760 | 20 | 174.9 | 168.2 | | | 1.61 | 16.86 |
| 760 | 20 | 173.5 | 165.3 | 174.2 | 166.8 | 2.03 | 16.64 |
| 780 | 5 | 188.9 | 180.0 | | | 1.80 | 16.55 |
| 780 | 5 | 189.8 | 181.8 | 189.4 | 180.6 | 1.68 | 16.78 |
| 780 | 10 | 186.4 | 177.7 | | | 1.84 | 16.88 |
| 780 | 10 | 185.7 | 178.0 | 186.1 | 177.8 | 1.67 | 16.82 |
| 780 | 15 | 181.8 | 173.7 | | | 1.91 | 16.86 |
| 780 | 15 | 181.1 | 172.8 | 181.5 | 173.2 | 1.99 | 16.89 |
| 780 | 20 | 176.3 | 167.6 | | | 1.80 | 16.76 |
| 780 | 20 | 179.1 | 171.2 | 177.7 | 169.4 | 1.83 | 16.81 |

TABLE 2

| Temp | FPM | T | Y | Avg T | Avg Y | E | M |
|---|---|---|---|---|---|---|---|
| 800 | 5 | 189.1 | 178.2 | | | 1.83 | 16.53 |
| 800 | 5 | 185.1 | 176.8 | 187.1 | 177.5 | 1.59 | 16.31 |
| 800 | 10 | 187.7 | 178.6 | | | 1.66 | 16.77 |
| 800 | 10 | 186.5 | 181.2 | 187.1 | 179.9 | 1.49 | 17.27 |
| 800 | 15 | 184.0 | 175.1 | | | 1.76 | 16.84 |
| 800 | 15 | 174.6 | 173.6 | 179.3 | 179.4 | 1.25 | 17.09 |
| 800 | 20 | 180.9 | 171.8 | | | 1.74 | 16.67 |
| 800 | 20 | 179.9 | 172.2 | 180.4 | 172 | 1.66 | 17.03 |
| 825 | 5 | 172.0 | 157.6 | | | 1.79 | 15.51 |
| 825 | 5 | 170.8 | 156.1 | 171.4 | 156.8 | 1.70 | 15.86 |
| 825 | 10 | 183.1 | 171.5 | | | 1.83 | 16.59 |
| 825 | 10 | 185.9 | 172.1 | 184.5 | 171.8 | 2.08 | 16.37 |
| 825 | 15 | 186.3 | 173.7 | | | 2.02 | 16.63 |
| 825 | 15 | 184.5 | 171.3 | 185.4 | 172.5 | 1.99 | 16.18 |
| 825 | 20 | 177.9 | 172.5 | | | 1.45 | 16.51 |
| 825 | 20 | 186.6 | 174.4 | 182.2 | 173.5 | 1.92 | 16.73 |
| 850 | 5 | 157.6 | 137.5 | | | 2.58 | 15.87 |
| 850 | 5 | 151.8 | 130.2 | 154.7 | 133.8 | 2.47 | 15.66 |
| 850 | 10 | 175.1 | 163.7 | | | 1.73 | 16.33 |
| 850 | 10 | 176.8 | 163.2 | 176.0 | 163.4 | 2.00 | 16.08 |

TABLE 2-continued

| Temp | FPM | T | Y | Avg T | Avg Y | E | M |
|---|---|---|---|---|---|---|---|
| 850 | 15 | 178.6 | 165.9 | | | 1.91 | 16.25 |
| 850 | 15 | 173.1 | 167.6 | 175.9 | 166.8 | 1.40 | 16.31 |
| 850 | 20 | 178.9 | 169.8 | | | 1.60 | 16.53 |
| 850 | 20 | 178.9 | 170.4 | 178.9 | 170.1 | 1.56 | 16.62 |

Figure 2:
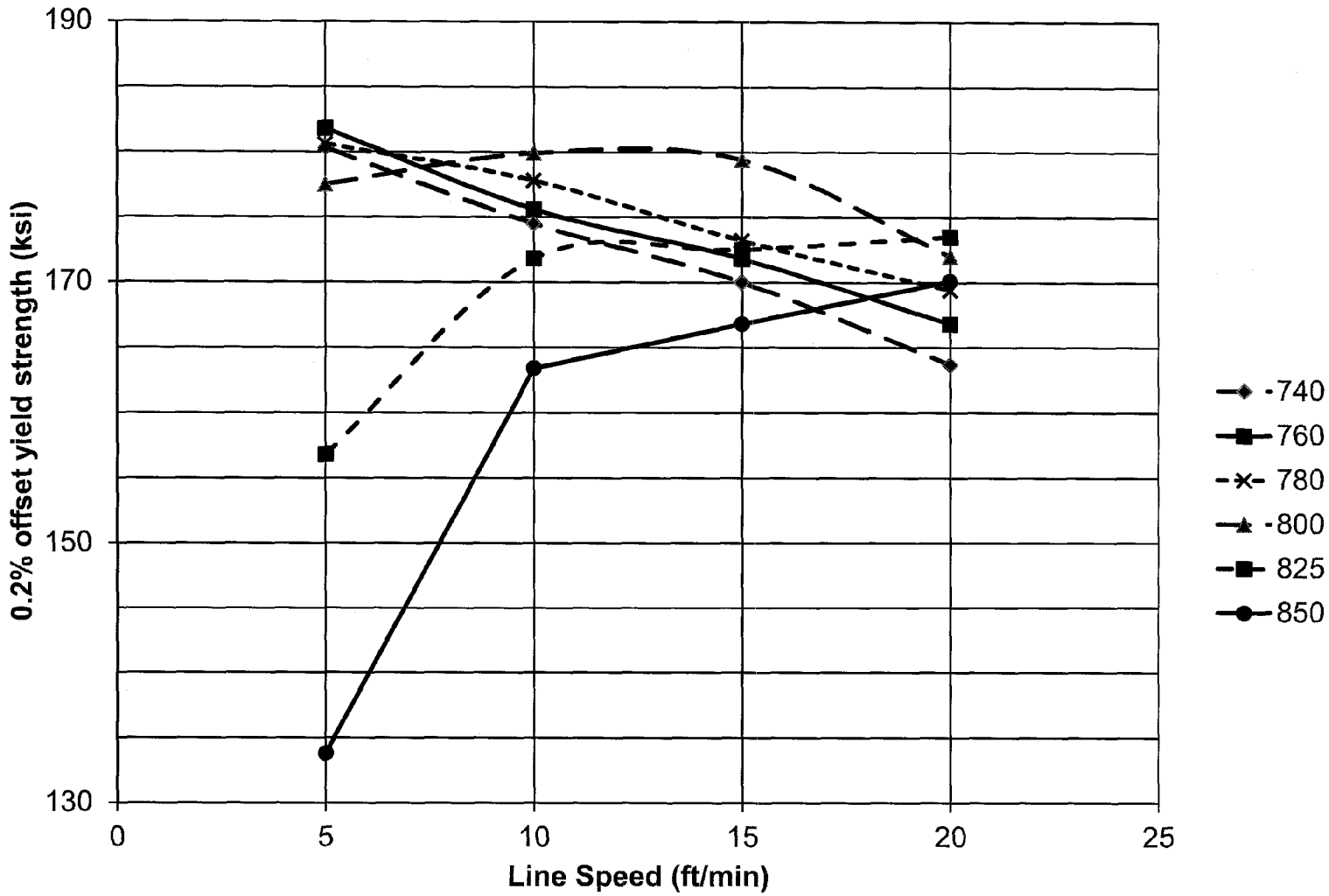
FIG. 2 is a graph showing the 0.2% offset yield strength versus line speed at different temperatures.

Summarizing, it was found that alloys having a minimum 0.2% offset yield strength of at least 175 ksi, an ultimate tensile strength of at least 180 ksi, a % elongation at break of at least 1%, and a Young's modulus of at least 16 million psi could be obtained. FIG. 2 is a graph showing the 0.2% offset yield strength versus line speed at the different temperatures. The minimum yield strength of at least 175 ksi is achieved over a wide temperature range.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

The invention claimed is:

1. A process for improving the yield strength of a wrought copper—nickel—tin alloy, comprising:

performing a first mechanical cold working step on the alloy to a percentage of cold working (% CW) of about 50% to about 75%; and heat treating the alloy;

wherein the resulting copper—nickel—tin alloy achieves a 0.2% offset yield strength of at least 175 ksi.

2. The process of claim 1, wherein the heat treating step is performed at a temperature of about 740° F. to about 850° F. for a period of about 3 minutes to 14 minutes.

3. The process of claim 2, wherein the heat treating step is performed at a temperature of about 740° F. to about 800° F.

4. The process of claim 1, wherein the heat treating step is performed by running the alloy in strip form through a furnace at a rate of about 5 ft/min to about 20 ft/min.

5. The process of claim 1, wherein the resulting alloy has a 0.2% offset yield strength of 175 to 190 ksi.

6. The process of claim 1, wherein the resulting alloy has an ultimate tensile strength of at least 180 ksi.

7. The process of claim 1, wherein the resulting alloy has a % elongation at break of at least 1%.

8. The process of claim 1, wherein the resulting alloy has a Young's modulus of at least 16 million psi.

9. The process of claim 1, wherein the resulting alloy achieves a 0.2% offset yield strength of at least 175 ksi and an ultimate tensile strength of at least 180 ksi.

10. The process of claim 1, wherein the copper—nickel—tin alloy includes from about 14.5 wt % to about 15.5 wt % nickel, and from about 7.5 wt % to about 8.5 wt % tin, with the remaining balance being copper.

* * * * *